US006405861B1

(12) United States Patent
Siler et al.

(10) Patent No.: US 6,405,861 B1
(45) Date of Patent: Jun. 18, 2002

(54) HANDGUN STORAGE CASE AND METHOD FOR SAFE AND QUICK ACCESS

(76) Inventors: Buzz Siler, 3328 Lakeview Blvd., Lake Oswego, OR (US) 97035; Montgomery Lee Nelson, 15900 S. Buckner Creek Rd., Mulino, OR (US) 97042; Richard L White, II, 48433 NW. Sylvia La., Forest Grove, OR (US) 97116

( * ) Notice: Subject to any disclaimer, the term of this patent is extended or adjusted under 35 U.S.C. 154(b) by 0 days.

(21) Appl. No.: 09/726,898

(22) Filed: Nov. 29, 2000

(51) Int. Cl.[7] ..... B65D 85/00

(52) U.S. Cl. ..... 206/317; 206/1.5; 220/810

(58) Field of Search ..... 206/317, 1.5, 349, 206/372; 220/810, 820, 823, 824; 312/215, 329

(56) References Cited

U.S. PATENT DOCUMENTS

| | | | | | |
|---|---|---|---|---|---|
| 439,562 | A | * | 10/1890 | Richards | 206/317 |
| 1,932,638 | A | * | 10/1933 | Rogers | 206/317 |
| 3,031,069 | A | * | 4/1962 | Hirsch | 206/317 |
| 4,309,065 | A | * | 1/1982 | Pappas | 312/319 |
| 4,542,848 | A | | 9/1985 | Peters | |
| 4,768,021 | A | | 8/1988 | Ferraro | |
| 4,800,822 | A | | 1/1989 | Adkins | |
| 5,056,342 | A | * | 10/1991 | Prinz | 70/63 |
| 5,111,545 | A | | 5/1992 | Krozal | |
| 5,111,755 | A | | 5/1992 | Rouse | |
| 5,118,175 | A | * | 6/1992 | Costello | 312/242 |
| 5,168,994 | A | | 12/1992 | Beletsky et al. | |
| 5,172,575 | A | | 12/1992 | Fisher | |
| 5,236,086 | A | * | 8/1993 | MacTaggart | 206/317 |
| 5,338,109 | A | | 8/1994 | Haines | |
| 5,344,010 | A | | 9/1994 | Dyer et al. | |
| 5,375,440 | A | | 12/1994 | Patterson | |
| 5,437,366 | A | | 8/1995 | West et al. | |
| D368,249 | S | | 3/1996 | Ferrer | |
| 5,579,909 | A | * | 12/1996 | Deal | 206/317 |
| 5,671,830 | A | * | 9/1997 | Wood | 150/101 |
| 5,678,686 | A | * | 10/1997 | Hagemann et al. | 206/315.11 |
| 5,701,770 | A | | 12/1997 | Cook et al. | |
| D395,746 | S | * | 7/1998 | Barackman | D3/201 |
| D410,130 | S | | 5/1999 | Kerr et al. | |
| 5,901,589 | A | | 5/1999 | Cordero | |
| 6,042,207 | A | * | 3/2000 | Crosby et al. | 312/351 |
| D426,059 | S | | 6/2000 | Siler et al. | |
| 6,082,601 | A | | 7/2000 | Standish | |

OTHER PUBLICATIONS

Qwikcase, http:www.qwikcase.com, Qwikcase Handgun Safes (Internet Website).

* cited by examiner

*Primary Examiner*—Shian Luong

(57) ABSTRACT

A new portable or mountable gun case device and method for safely storing one of a variety of loaded and unloaded firearms. The gun case includes a child-resistant latching mechanism. A lockable case that protects children from senseless handgun accidents, yet allows quick access to a handgun to protect a family in an emergency. The unique case design allows mounting beside the bed, under a desk or counter, in a car, truck or RV, and in the wall (behind a picture) with optional pivoting wall bracket. The handgun case can be recessed in a wall behind a picture. Each case includes holster that adjusts to every gun size. The unique drop-down door delivers a gun the same way every time: safely pointed down. The case has unique safety and convenience features and options.

3 Claims, 4 Drawing Sheets

HANDGUN STORAGE CASE AND METHOD FOR SAFE AND QUICK ACCESS

CROSS-REFERENCE TO REALATED APPLICATIONS

A safe for loaded handgun is disclosed in U.S. Pat. No. 4,768,021, issued to Ferraro, which provides an access door hinged at the top. The safe does not disclose a means for attaching a gun upon the inside of the door for convenient gun access. Mounting a gun to the door would be cumbersome from gravity alone.

A gun safe with ejectable drawer is disclosed in U.S. Pat. No. 4,800,822, issued to Adkins, which provides a sliding drawer. The safe does not disclose a means for fast access to a gun. The user must pull out a drawer before accessing a gun.

A holster mount is disclosed in U.S. Pat. No. 5,111,545, issued to Krozal, which provides a mountable gun holster. The holster mount does not disclose a means for attaching itself to the inside of a case or safe door. The main purpose of the design is to provide a holster accessible from a bed part.

A safe gun storage apparatus is disclosed in U.S. Pat. No. 5,111,755, issued to Rouse, which provides a removable top section to access a gun. The safe does not disclose a means for attaching a gun to a door or for mounting a gun with the barrel pointed downwards.

A handgun storage container is disclosed in U.S. Pat. No. 5,168,994, issued to Beletsky, et al., which provides a front door hinged at the top. The container does not disclose a means for attaching a gun upon the inside of the door for convenient gun access and does not provide a means for the gun barrel being pointed downwardly at all times for safety. This container shows how a gun must be contained in a time-consuming trigger lock rather than a quick release holster.

A gun box latching mechanism is disclosed in U.S. Pat. No. 5,172,575, issued to Fisher, which provides a lunch box-like method of storing a gun. This method does not provide the benefits of the instant invention to include a holster mounted to a door and a box where the gun barrel must be pointed downwards for safety.

A handgun safety storage cabinet is disclosed in U.S. Pat. No. 5,338,109, issued to Haines, which provides a front door hinged on a side. The safe does not disclose a means for attaching a gun upon the inside of the door for convenient gun access nor does it provide a way for a gun to be continuously pointed downwards for safety.

A handgun case with lock and block is disclosed in U.S. Pat. No. 5,344,010, issued to Dyer, et al., which provides a case having a top section hinged to a bottom section. There is no means for attaching a gun to a hinged door for quick access within a holster. The gun is not normally pointed downwardly for safety.

A lockable storage case for a handgun is disclosed in U.S. Pat. No. 5,375,440, issued to Patterson. There is no means for attaching a gun to a hinged door for quick access within a holster. The gun is not normally pointed downwardly for safety.

A handgun storage container for emergency access is disclosed in U.S. Pat. No. 5,437,366, issued to West, et al. There is no means for attaching a gun to a hinged door for quick access within a holster. The gun is not normally pointed downwardly for safety.

A gun safe with dual method of gaining access therein is disclosed in U.S. Pat. No. 5,701,770, issued to Cook, et al.

There is no means for attaching a gun to a hinged door for quick access within a holster. The gun is not normally pointed downwardly for safety. The user must use a fingerprint or access card to gain entry to the safe.

A quick opening handgun safe is disclosed in U.S. Pat. No. 5,901,589, issued to Cordero. There is no means for attaching a gun to a hinged door for quick access within a holster. The gun is not normally pointed downwardly for safety.

A a gun storage device is disclosed in U.S. Pat. No. 6,082,601, issued to Standish. There is no means for attaching a gun to a hinged door for quick access within a holster. The gun is not normally pointed downwardly for safety.

A vehicle safe is disclosed in U.S. Pat. No. Des. 368,249, issued to Gerrer, which provides a front door hinged near the center. The safe does not disclose a means for attaching a gun upon the inside of the door for convenient gun access. The main purpose of the design is to provide a lockable compartment for a vehicle.

A lock box attachable to furniture is disclosed in U.S. Pat. No. Des. 410,130 issued to Kerr, which provides a front door hinged at the bottom. The box does not disclose a means for attaching a gun upon the inside of the door for convenient gun access. The main purpose of the design is to provide a lockable compartment for furniture.

A handgun storage case is disclosed in U.S. Pat. No. Des. 426,059, issued to Siler, et al., which portrays the present invention in a design scope rather than utilitarian.

A strong box is disclosed in U.S. Pat. No. 4,542,848, issued to Peters, which provides a front door hinged near the top. The box does not disclose a means for attaching a gun upon the inside of the door for convenient gun access. The purpose of the design is to provide a lockable compartment where mounting a gun to the door would be cumbersome.

Other existing gun cases and safes exist but require a maze-type or other complicated manipulation of a mechanism to safely gain access to a gun. Some of these devices could easily confuse a responsible owner attempting to open the box—particularly when in an agitated state of mind and in a great hurry. Moreover, children have been known to demonstrate how to open boxes of that type to an adult unable to do so.

The prior attempts to develop a gun box that allows easy access by authorized adults yet prevents unauthorized or accidental access have not been completely satisfactory. In part, the problem is that existing cases have not been widely accepted—either because adults find them inconvenient or because children can open them. The need for safer and speedier access more effective than those presently available is apparent.

OBJECTS AND ADVANTAGES

To overcome the shortcomings of present handgun cases, a new access method is provided. Although handgun cases have been provided in the past, a method for storing a handgun with the barrel pointed down may be included to provide a further degree of safety integrity against an accident.

Accordingly, several objects and advantages of our present invention are:

1. to provide a handgun case that offers substantially quick access, but only to the owner, to the contents of the box;
2. to provide a handgun case that avoids exposing unnecessarily the fact that the box of the present invention encloses a weapon;

3. to provide a handgun case that is economical to manufacture;
4. to provide a handgun case that is portable;
5. to provide a handgun case that is optionally mountable to a suitable surface;
6. to provide a handgun case that has an attractive appearance;
7. to provide a handgun case that offers the prevention of inadvertent opening when, for example, the box is dropped, by providing a sturdy and reliable latching mechanism;
8. to provide a box that will store safely one or more handguns, including a variety of firearms and ammunition;
9. to provide a handgun case that accommodates both loaded and unloaded handguns without the need for a child safety lock or trigger lock for use outside of a case.
10. to provide a handgun case that holds the handgun in a singular and predictable manner, pointed downwardly from the case opening and person accessing the handgun;and
11. to provide a handgun case with an inconspicuous (second) backup latch to lessen the ability of young children to access the contents of the case.

BACKGROUND OF THE INVENTION

This invention relates to gun cases and, more particularly, to handgun cases that provide quick and easy opening of while providing a child-resistant safety feature. With the new laws restricting access to guns by minors, putting your gun under your pillow or mattress is no longer acceptable.

Many people have firearms for recreational use such as target shooting. Others collect firearms. Moreover, an ever-increasing number of people are keeping guns, such as automatic pistols and revolvers, in their homes and offices for protection. No matter what the purpose for the gun, the gun owner must have a safe storage box to protect the gun against unauthorized access and accidental discharge or misuse.

The presence of a gun in the home or office is a perpetual concern for the owner. Newspaper accounts and word of mouth have recounted the numerous accidents and tragedies associated with the accidental discharge of firearms each year. A large number of serious injuries and fatalities occur to young children. The gun owner also fears arriving at home or work to find an intruder waiting with the owner's own gun. Thus, unauthorized access even by adults is a concern.

In contrast to the owner's need for a gun box which prevents unauthorized and accidental opening is the need for immediate access to the gun box and quick and easy grasping of the gun once access is obtained. When the owner suddenly realizes that the gun is needed because an intruder has entered the home or office, the gun box must be immediately accessible—then easily opened. Thus, although the cardinal requirement in preventing children's accidents would be to keep the gun box out of sight and out of reach of the child, that requirement may thwart the owner's purpose in storing the gun: immediate accessibility. A gun kept unloaded in a closet would cost the owner precious time in a crisis situation.

There are several types of existing devices that have been used to carry and store dangerous firearms. Most existing gun cases do not have the barrel pointed downwardly during access. Such boxes make gun handling more dangerous, however, which could result in an injury or fatality of the gun accidentally fired during removal. Consequently, the owner could be liable for such a tragedy, even if the owner did not commit the accident. Every parent is aware of the ingenuity of children who, after observing a person use a key to open and close a box, could easily follow the example and gain access to the dangerous contents within.

All of these factors could pose a serious hindrance in situations of haste or emergency when the gun is needed quickly.

BRIEF SUMMARY OF THE INVENTION

To achieve these and other objects, and in view of its purposes, the present invention provides a portable or mountable gun case for safely storing at least one of a variety of loaded and unloaded firearms, particularly for handguns. The gun case includes a child-resistant latching mechanism.

It is to be understood that both the foregoing general description and the following detailed description are exemplary, but are not restrictive, of the invention.

BRIEF DESCRIPTION OF THE SEVERAL VIEWS OF THE DRAWING

The invention is best understood from the following detailed description when read in connection with the accompanying drawing, in which.

REFERENCE NUMERALS IN DRAWINGS

Figure 1:
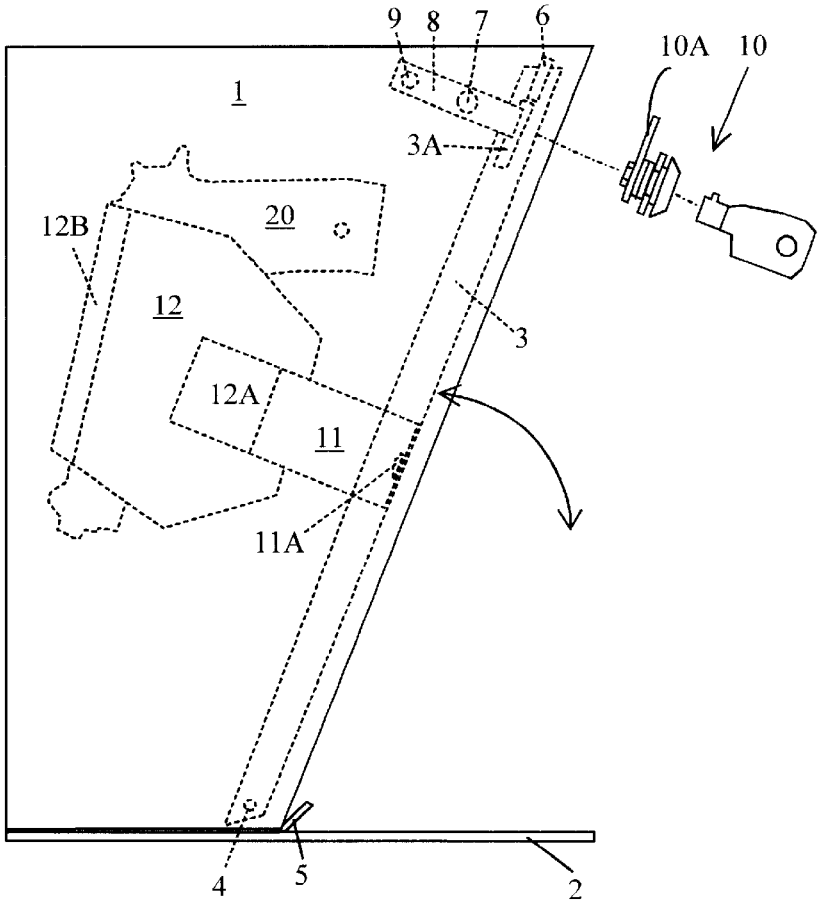
FIG. 1 is a side view of a handgun case with a locking assembly in exploded view.
Figure 2:
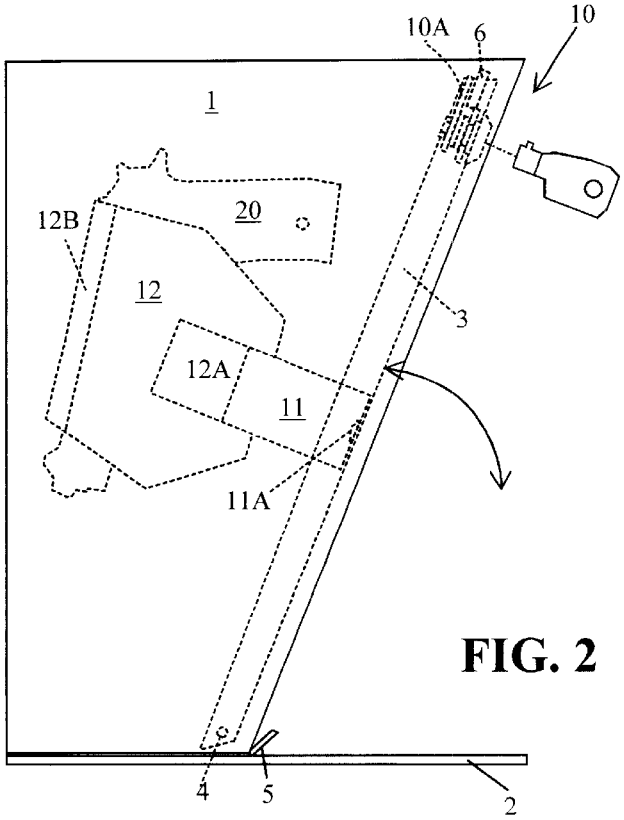
FIG. 2 is a side view of a handgun case with the door locked.

1 frame or housing
2 base plate
2A base plate void
3 door
3A door void
4 door hinge
5 bottom door stop
6 top door stop
7 quick release button
8 quick release plate
9 bolt and nut
10 lock assembly
10A lock bar
11 holster mount
11A bolt and nut
12 holster
12A holster sleeve
12B holster hook and loop fastener
20 handgun

DETAILED DESCRIPTION OF THE INVENTION

Figure 3:
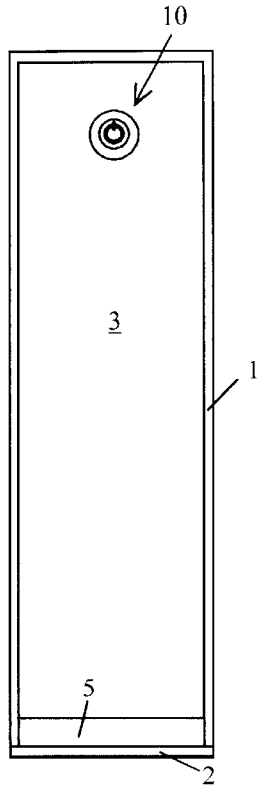
FIG. 3 is a front view of a handgun case.
Figure 4:
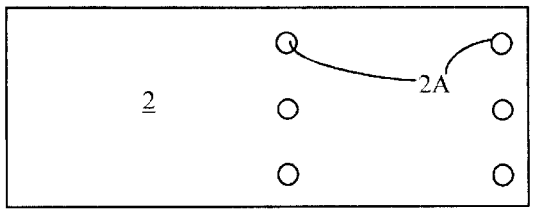
FIG. 4 is a bottom view of a handgun case.
Figure 5:
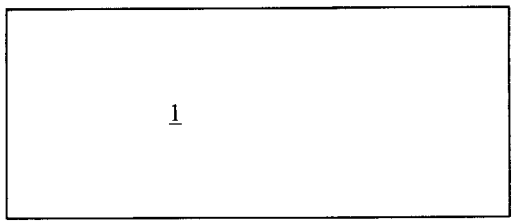
FIG. 5 is a top view of a handgun case.
Figure 6:
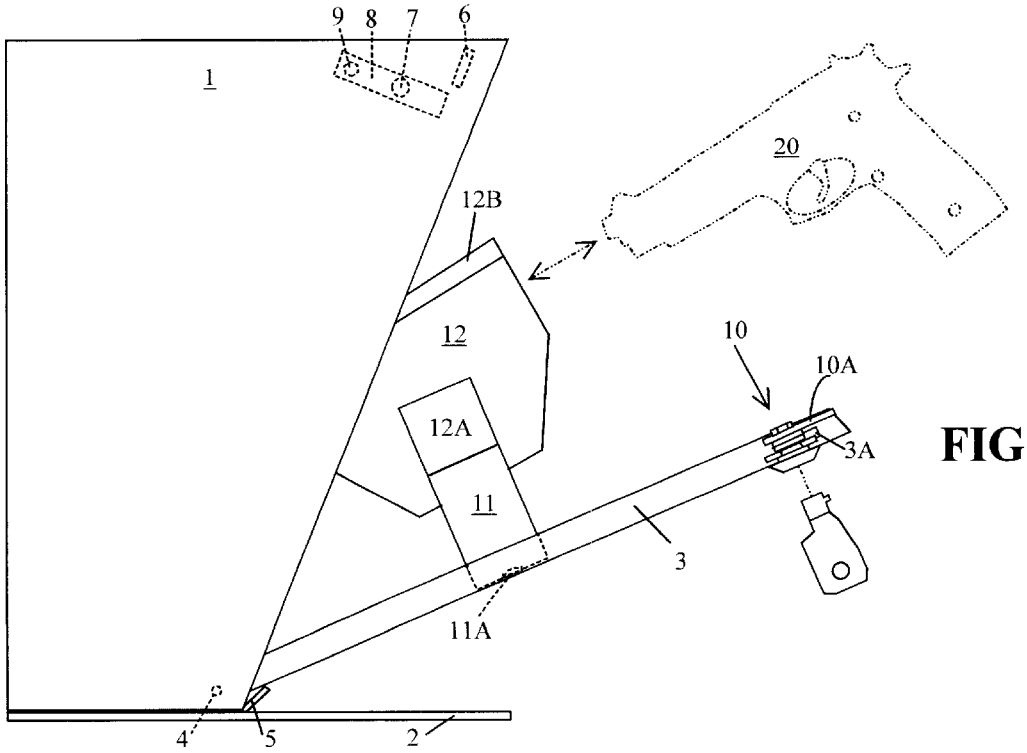
FIG. 6 is a side view of a handgun case with the door open and a sample handgun.
Figure 7:
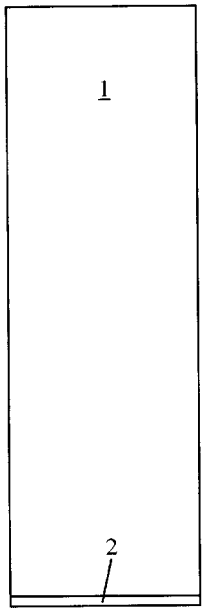
FIG. 7 is a back view of a handgun case.

Referring now to the drawings, wherein like reference numerals refer to like elements throughout, FIGS. 1 through 8. The preferred embodiment of the present handgun case is illustrated in FIGS. 3 (front view), 4 (bottom view), 5 (top view) and 8 (perspective view). The size of parts may be estimated by comparing them to a handgun 20 of average size.

Placing and removing handgun 20 from any case or safe with the handgun barrel pointed sidewardly is dangerous. In the instant invention, when the handgun case is in the normal upright position, the handgun barrel is pointed down or downwardly enough for safety at all times during storage, removal, and insertion.

In FIGS. 1, 2, 3, 5, 6, and 8 a case or frame 1, a base plate 2 and a door 3 are made of 10-gauge steel, laser cut, welded and powder-coated, and secured with a lock assembly 10. Frame 1 is of rigid strength with at least five walls or sides for housing a handgun of any type or size and is relatively box-shaped to house one or more handgun 20. A handgun case that houses more than one handgun is not shown, but is an alternative embodiment. Such an alternative embodiment would be the present invention made wider with one or more dividers, the dividers being used if each handgun were to be locked separately.

Frame 1 may be securely attached to any mounting surface by using a nut and bolt (not shown) through a base plate void 2A (or a plurality of base plate void 2A). An optional pivoting wall bracket (not shown) may be used to secure the handgun case by attaching wall bracket (not shown) to frame 1 by using nuts and bolts (not shown) through a plurality of base plate void 2A. Frame 1 may have several holes or voids such as base plate void 2A for securing or mounting the handgun case. The voids may be distributed as necessary for a variety of mounting situations. Base 2 is a flat bar welded or operatively secured to frame 1 that provides support for all other components. It has base plate voids 3 for securing itself to a suitable mounting surface with a bolt and nut set (not shown).

Door 3 is connected to frame 1 by a door hinge 4. Door hinge 4 is a simple shaft pivot, pivotably mounted to frame 1 on both sides of frame 1 and door 3. Door 3 is a drop down type by gravity. Door 3 has a bottom door stop 5 to prevent door 3 from opening too far to the base and thus keeping handgun 20 barrel pointed more downwardly. A top door stop 6 keeps door 3 from entering frame 1 too far and also serves as a retainer for a lock bar 10A of a lock assembly 10. Lock assembly 10 is a high security tube key type lock, but may also be an optional pushbutton lock to eliminate the need for a key. Not shown is another option for lock assembly 10: An electronic keypad and automatic deadbolt lock. Lock assembly 10 is operatively mounted to door 3 by a general bolt and nut configuration. Lock assembly 10 locks in place to frame 1 by a quick release plate 8 mounted to frame 1 with a bolt and nut 9. Quick release plate 8 is pushed from the outside of frame 1 by a quick release button inwardly to release door 3 from quick release plate 8. Quick release button 7 is operably mounted to a small hole or void in the side of frame or housing 1 so that quick release button 7 springs or flexes in and out of frame or housing 1 against flexible quick release plate 8. Pushing quick release button 7 inwardly will disengage quick release plate 8 from door 3, thus allowing door 3 to open with gravity. Door 3 is closed when the curved end of quick release plate 8 snaps into door void 3A. During this process, quick release plate 8 flexes inwardly (from pressure of quick release button 7) as door 3 slides by the end of quick release plate 8. Quick release plate 8 snaps into door void 3A, thus closing door 3. This allows door 3 to be closed without utilizing locking assembly 10. Lock assembly 10 only engages with top door stop 6. A door void 3A snaps into quick release plate 8 securely when door 3 is closed. Door void 3A is located at the outer end of one side of door 3 and is parallel with door 3, about one inch in length and a few millimeters wide. Door void 3A will be on the same side of door 3 that quick release plate 8 is. Since most people are right handed, it is preferred for the quick release system (quick release plate 8 and associated parts) be on the right side of the handgun case.

Figure 8:
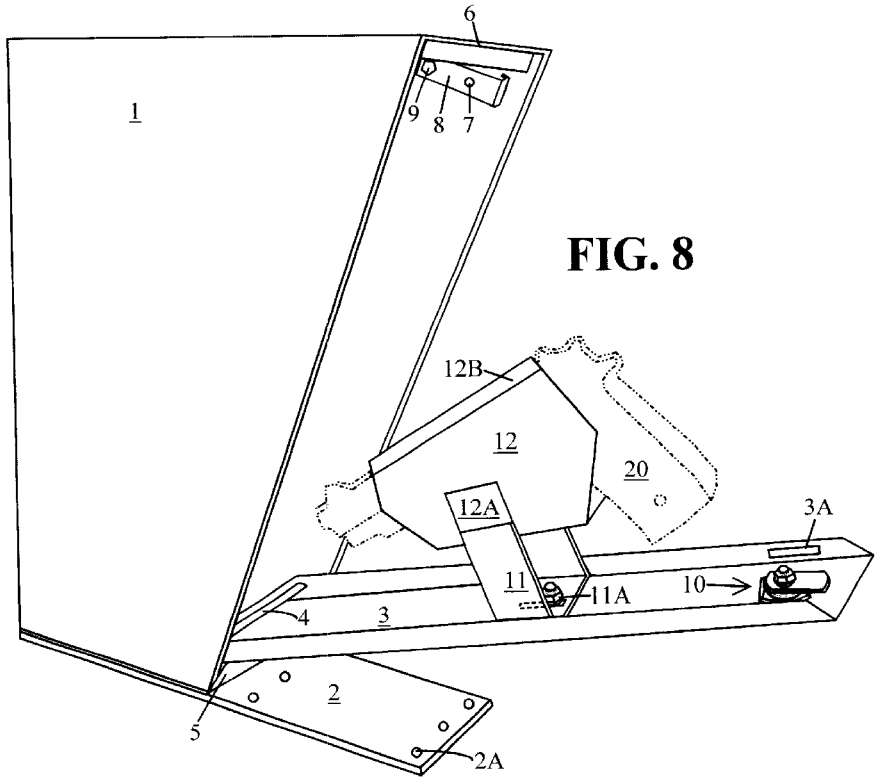
FIG. 8 is a perspective front and side view of a handgun case open.

Door 3 has a holster mount 11 mounted to door 3 by way of a bolt and nut 11A. Holster mount 11 has a void as shown in FIG. 8 just beneath where bolt and nut 11A is located to allow holster mount 11 to slide forwards and backwards to accommodate handgun 20 whatever size it may be. When handgun 20 is stored in the handgun case, handgun 20 is secured to a holster 12 particularly with a holster hook and loop fastener 12B. Holster hook and loop fastener 12B is adjustable to accommodate various sized and shaped handgun 20s. Holster 12 has a holster sleeve 12A so holster mount 11 slides into holster 12 at the holster sleeve 12A location.

Although illustrated and described herein with reference to certain embodiments, the present invention is nevertheless not intended to be limited to the details shown. Rather, various modifications may be made in the details within the scope and range of equivalents of the claims and without departing from the spirit of the invention.

We claim:

1. A device for securely storing a handgun in a case or frame, the device comprising:

a box-like frame of rigid strength for housing a handgun of any type or size, said frame having a rigid base plate extending forwardly, said frame having a front door attached to said frame; said front door having a pivotal end, said pivotal end having a pivotal axis for attachment coincident with said frame at a bottom front of said frame, whereby said door drops down automatically by way of gravity when open, said door further including an operatively mounted lock assembly near a top of said frame, said lock assembly capable of locking to said frame on said top and a front, said door having a handgun holster operatively mounted to said door by way of a holster mount, whereby when said door is opened, said handgun is easily and safely accessed with said handgun barrel pointed to said door by a bolt and nut, said bolt and nut allowing an adjustment means for said holster mount to slide parallel with said door to accommodate said handgun of different sizes.

2. The device for securely storing a handgun according to claim 1, further including a holster hook and loop fastener at a top of said handgun holster for custom and snug fit of said handgun.

3. The device for securely storing a handgun according to claim 1, further including a releasably mounted base plate to said frame at a bottom of said frame.

* * * * *